US005881507A

United States Patent [19]

Yoo et al.

[11] Patent Number: 5,881,507

[45] Date of Patent: Mar. 16, 1999

[54] INTEGRATED HORIZONTAL AND VERTICAL SEISMIC ISOLATION BEARING

[75] Inventors: Bong Yoo; Gyeong-Hoi Koo; Jae-Han Lee; Mann Cho, all of Daejeon-Si, Rep. of Korea

[73] Assignees: Korea Atomic Energy Research Institute; Korea Electric Power Corporation, both of Seoul, Rep. of Korea

[21] Appl. No.: 739,969

[22] Filed: Oct. 30, 1996

[30] Foreign Application Priority Data

Jul. 19, 1996 [KR] Rep. of Korea ..... 1996-29106

[51] Int. Cl.[6] ..... E04B 1/36

[52] U.S. Cl. ..... 52/167.8; 248/565

[58] Field of Search ..... 52/167.4, 167.7, 52/167.8; 248/565, 636, 638

[56] References Cited

U.S. PATENT DOCUMENTS 5,018,701 5/1991 Masaki ..... 52/167.8
5,156,451 10/1992 Pollock ..... 248/636

FOREIGN PATENT DOCUMENTS 2254974 7/1975 France ..... 52/167.8
2248549 10/1990 Japan ..... 52/167.7

*Primary Examiner*—Michael Safavi
*Attorney, Agent, or Firm*—Armstrong, Westerman, Hattori, McLeland & Naughton

[57] ABSTRACT

A seismic isolation bearing device is disclosed in which a laminated elastic rubber-steel bearing adapted to isolate horizontal seismic loading cooperates with a vertical isolation device employing a compression spring, or equivalent device, effective for isolating vertical seismic loadings whereby a three dimensional seismic isolation device is effective to isolate both vertical and horizontal seismic loadings to insure the structural integrity of a superstructure against damage induced by seismic events. The isolation device formed of an isolation cylinder fixed to the structure, with an upper fixing plate vertically movable within the cylinder. A plurality of steel balls being disposed within a space formed between the perimeter of the upper fixing plate and the interior wall of the isolation cylinder. The balls facilitating the guided relative vertical movement between the upper fixing plate and the isolation cylinder. A compression spring within the cylinder and between the upper fixing plate and the structure serves to dampen the vertically imposed seismic loads.

1 Claim, 3 Drawing Sheets

INTEGRATED HORIZONTAL AND VERTICAL SEISMIC ISOLATION BEARING

BACKGROUND OF THE INVENTION

This invention relates to an integrated horizontal and vertical seismic isolation bearing (ISIB). More specifically, an ISIB is a device which is installed between the ground and a superstructure and is utilized to block the energy of an earthquake being transferred from the ground to the superstructure. Seismic isolation bearings, which are installed between the ground and a superstructure, are devices effective to maintain the structural integrity of the superstructure by blocking the energy of an earthquake from being transferred from the ground to the superstructure. Conventionally used seismic isolation bearings are laminated elastic rubber-steel bearings which have a complex laminated structure or laminated rubber-steel bearings with embedded lead which can increase damping characteristics. These laminated elastic rubber-steel bearings are effective for only horizontal seismic isolation. Therefore, laminated elastic rubber-steel bearings, which are installed between the ground and a superstructure, provide excellent seismic isolation performance for a horizontal direction; however, seismic responses of a superstructure of large amplification can occur in a vertical direction due to the high vertical stiffness of such laminated elastic rubber-steel bearings.

Conventional laminated elastic rubber-steel seismic isolation bearings are used only for horizontal seismic isolation and have a high vertical stiffness to support the total weight of an isolated superstructure. It is difficult, therefore, for this horizontal seismic isolator with high vertical stiffness to provide vertical seismic isolation of body motion in a vertical direction of a rigid superstructure.

SUMMARY OF THE INVENTION

The ISIB of the present invention is a three-dimensional seismic isolation device which combines properties of a conventional laminated elastic rubber-steel bearing for horizontal isolation with a vertical isolation device, such as a coil spring and/or vertical, laminated rubber-steel device. Specifically, the ISIB of the present invention is a horizontal seismic isolator device having a laminated elastic rubber-steel bearing combined with a vertical seismic isolation device using a coil spring and/or vertical laminated rubber-steel device dependent upon the weight of the superstructure to be isolated. The disclosed ISIB is an innovative three-dimensional seismic isolation device operative in both horizontal and vertical directions which can ensure the structural integrity of a superstructure during earthquake events. The fabrication and the assembly of the inventive ISIB are easy and the operation mechanism thereof is very simple. Therefore, the inventive ISIB is an excellent seismic isolation device for a seismically base-isolated system when subjected to both horizontal and vertical earthquakes.

Thus, this invention is intended to create a three-dimensional seismic isolator for both horizontal and vertical directions which is made by combining properties of a conventional laminated elastic rubber-steel bearing with those of a vertical isolation device comprising a coil spring or other vertical laminated rubber-steel device, several steel balls and a vertical isolation cylinder.

DESCRIPTION OF A PREFERRED EMBODIMENT OF THE INVENTION

Figure 1:
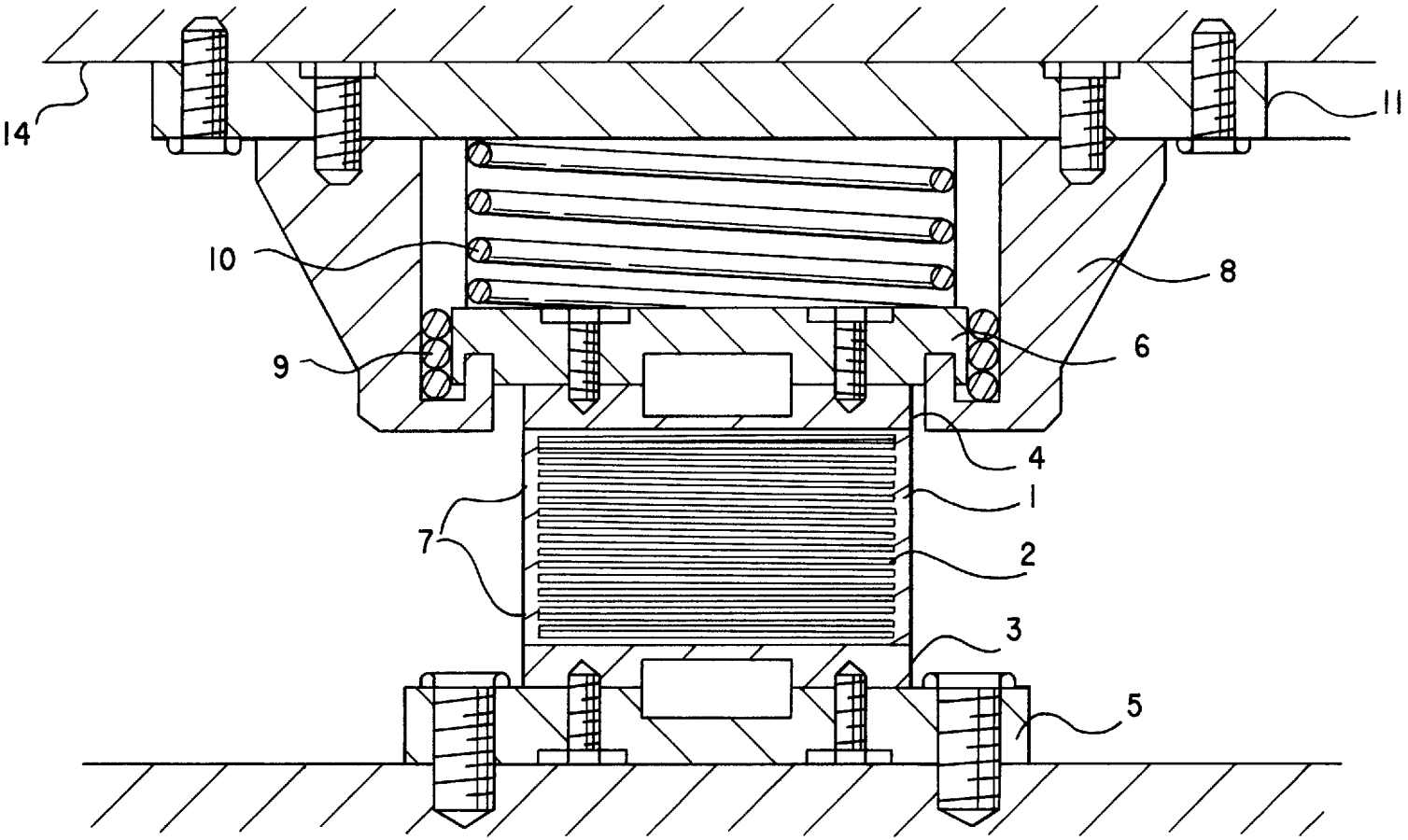
FIG. 1 is a sectional elevation view of an integrated horizontal and vertical seismic isolation bearing according to the invention.
Figure 2:
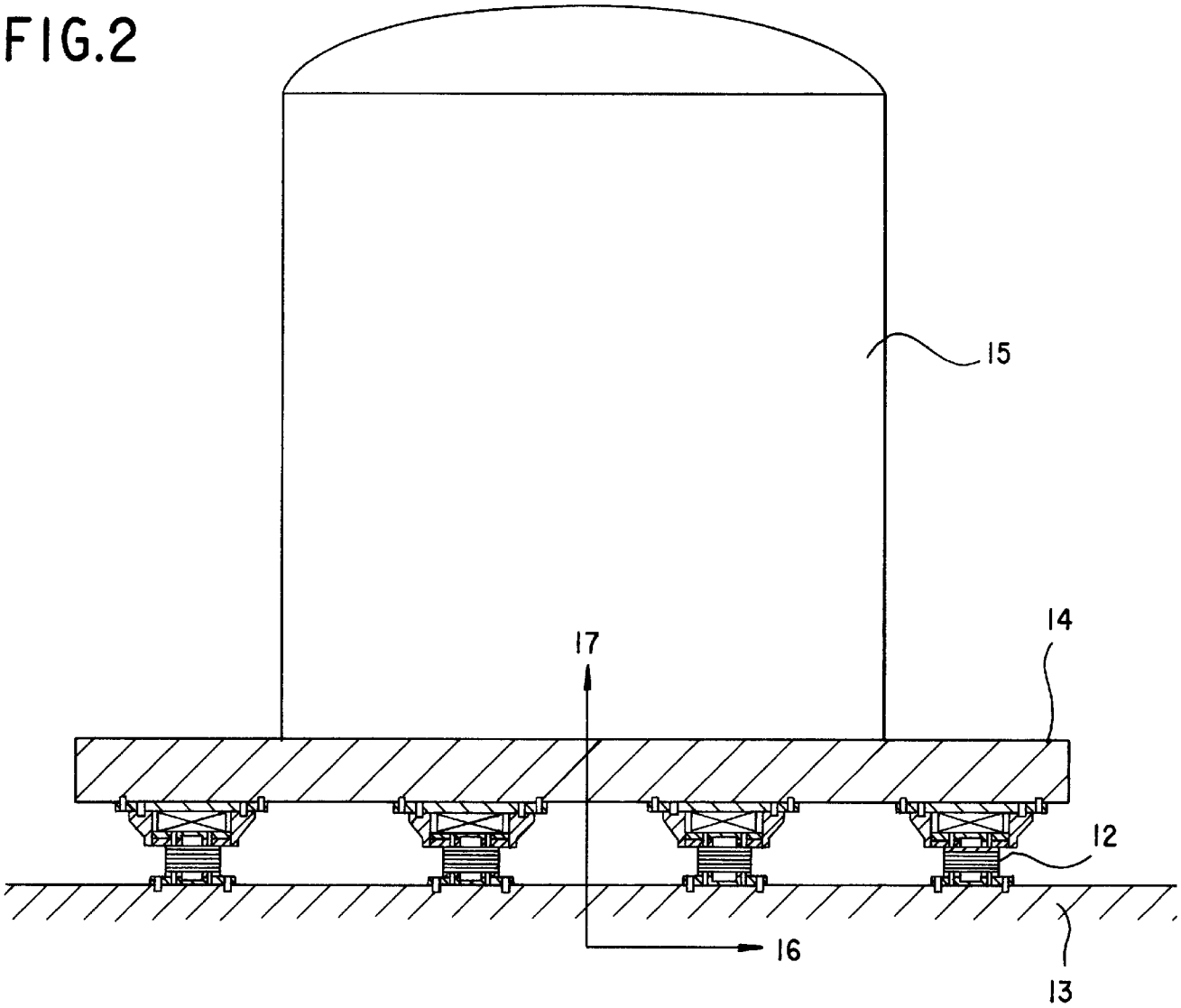
FIG. 2 shows installation positions and the isolation directions for integrated horizontal and vertical seismic isolation bearings as shown in FIG. 1 as an example applied to a structure.

FIG. 2 illustrates an ISIB (12) which is installed between an upper base (14) and a lower base (13) operative to block earthquake energy from being transferred from the ground to a superstructure in both a horizontal direction (16) and a vertical direction (17). This ISIB is a three-dimensional seismic isolation device that combines properties of a horizontal isolation device with properties of a vertical isolation device. As shown in FIG. 1, the horizontal isolation device comprises a shear key (7) including an elastic rubber (1) containing a plurality of steel plates (2) and disposed between a lower end plate (3) and an upper end plate (4), which, in turn, are attached to a body lower fixing plate (5) and an upper fixing plate (6), respectively. The vertical isolation device consists of a vertical isolation cylinder (8), steel balls (9), vertical isolation spring (10) and an upper connecting plate (11).

For producing the horizontal seismic isolation, the ISIB mechanism for horizontal earthquake forces includes a complex structure consisting of laminated elastic rubber (1) and steel plates (2), which is much more flexible in a horizontal direction than the illustrated superstructure (15) and, when horizontally deflected invokes the rigid body motion of superstructure (15), such that a horizontal seismic response amplification does not occur in superstructure (15). In the operation of the present invention, the reaction force for deflection of the horizontal isolation device at the upper fixing plate (6) is obtained from a load path extending through steel balls (9), vertical isolation device cylinder (8) and upper connecting plate (11). The shear key (7) installed between end plates (3,4) and fixing plates (5,6) is a safety device which has a function of transmitting shear load when loss of the function of shear load transmission through bolts occurs.

For vertical seismic isolation for vertical earthquake forces, the operation of the described ISIB mechanism is such that the up and down deflection of the vertical isolation spring (10) which is much more flexible in the vertical direction than that of the superstructure (15), invokes the rigid body motion of the superstructure (15); therefore, a vertical seismic response amplification does not occur in the superstructure (15). In this operation the steel balls (9), which are installed between the upper fixing plate (6) and the vertical isolation device cylinder (8), guide the vertical motion of the superstructure (15) smoothly. As shown in FIG. 1, the manner of vertical connection between the upper fixing plate (6) and the vertical isolation device cylinder (8) involves a cooperative vertical insertion between a projection on the cylinder (8) and a groove in the upper fixing plate (6) allowing the superstructure (15) to move smoothly.

The assembling procedure of the described ISIB is as follows;

1) connect the horizontal isolation device including parts (1,2,3,4) with the lower fixing plate (5) using bolts;
2) insert the upper fixing plate (6) into the vertical isolation device cylinder (8) and install steel balls (9)

inside the gap between the upper fixing plate (6) and the vertical isolation device cylinder (8);

3) connect the upper fixing plate (6) with the upper end plate (4) using bolts after putting the shear key (7) between the plates (3,4); and 4) install the vertical isolation spring (10) into the vertical isolation device cylinder (8) and connect the vertical isolation device cylinder (8) with an upper connecting plate (11) using bolts.

The connection between the ISIB and a lower base (13) is effected by bolting through the lower fixing plate (5). The connection between the ISIB and the upper base (14) of superstructure (15) is effected by bolting through the upper connecting plate (11).

Figure 3:
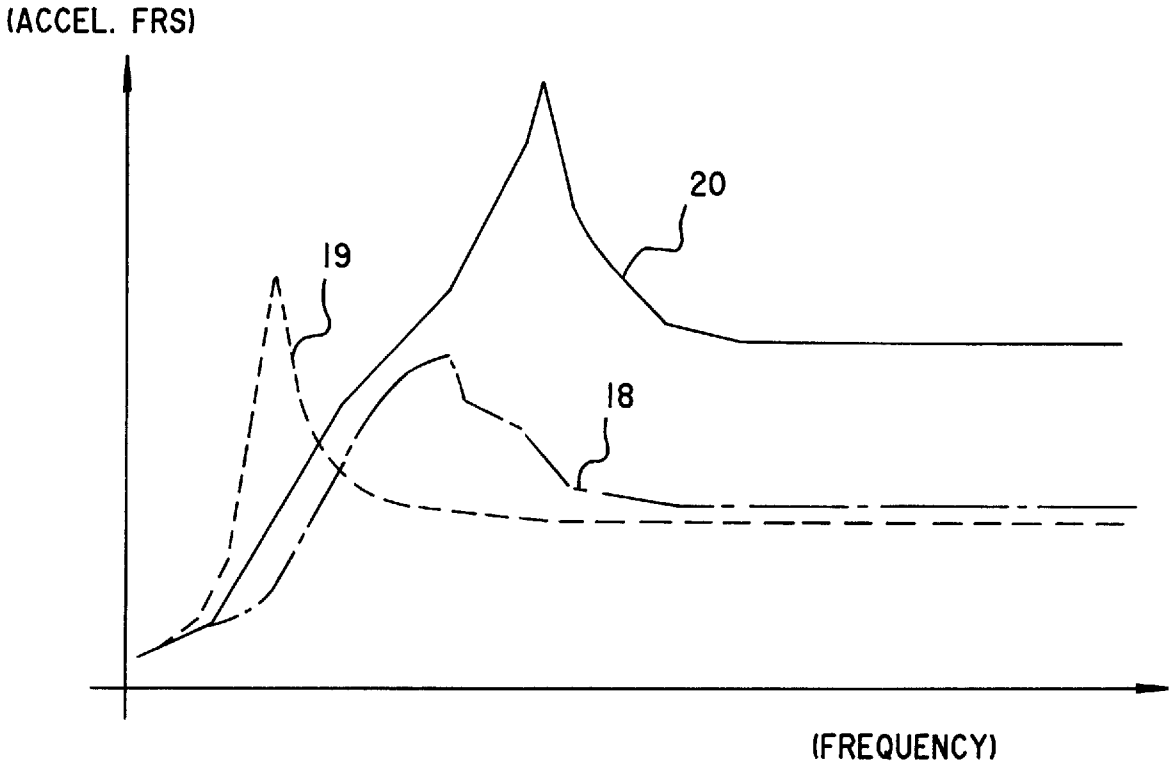
FIG. 3 is a graph illustrating the seismic responses at the superstructure in a seismically base-isolated structure equipped with the integrated horizontal and vertical seismic isolation bearings of the invention when subjected to an earthquake.

FIG. 3 shows a graph illustrating the seismic isolation performance of a seismic isolated system utilizing the described ISIB. As shown in FIG. 3, the seismic responses of a seismically isolated system with the ISIB of the invention are significantly reduced, as compared with those of a non-isolated system. The seismically isolated system utilizing the ISIB device can be designed having lower isolation frequency than that of superstructure (15) which ensures the rigid body motion of superstructure and, consequently, avoids the dominant frequency range of input motion.

From the foregoing, it is obvious that this invention can be applied to seismic isolation designs of nuclear power plants and non-nuclear structures which are expected to be damaged by earthquakes, such as hospitals, public buildings, semiconductor factories, LNG tanks, safety related main equipment and components, etc. and, thus, removes from the environment of such facilities the danger of earthquake damage.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A seismic isolation bearing device for imposition between a base and a superstructure comprising;

a shear key effective to damp horizontally imposed seismic loads fixedly secured to said base, a vertical isolation cylinder containing a hollow interior fixed with respect to said superstructure, an upper fixing plate connected to said shear key, said upper fixing plate being contained in the interior of said vertical isolation cylinder and being vertically movable with respect thereto;

guide means for guiding the movement of said upper fixing plate with respect to said vertical isolation cylinder comprising said upper fixing plate cooperating with an interior wall of said vertical isolation cylinder to define a space therebetween, and a plurality of balls disposed in said space between said upper fixing plate and said cylinder wall to facilitate guided relative vertical movement between said upper fixing plate and vertical isolation cylinder, and a compression spring for damping vertically imposed seismic loads disposed between said upper fixing plate and said superstructure.

* * * * *